United States Patent [19]

Whiting et al.

[11] Patent Number: 4,629,009

[45] Date of Patent: Dec. 16, 1986

[54] METHOD AND APPARATUS FOR FIRING BOREHOLE PERFORATING APPARATUS

[75] Inventors: Paul E. Whiting, Houston; Gerald B. McClure, Sugarland, both of Tex.

[73] Assignee: Dresser Industries, Inc., Dallas, Tex.

[21] Appl. No.: 648,447

[22] Filed: Sep. 10, 1984

[51] Int. Cl.[4] ..... E21B 43/116; E21B 29/00

[52] U.S. Cl. ..... 175/4.56; 166/55.1; 166/297; 175/299; 175/304

[58] Field of Search ..... 175/4.54, 4.56, 299, 175/300, 304; 166/55.1, 297, 299; 89/1.15; 102/322

[56] References Cited

U.S. PATENT DOCUMENTS

| | | | |
|---|---|---|---|
| 2,155,322 | 4/1939 | McCullough | 164/0.5 |
| 2,305,139 | 12/1942 | Collins | 175/4.56 X |
| 2,621,025 | 12/1952 | Denning | 175/304 X |
| 2,873,675 | 1/1959 | Lebourg | 102/20 |
| 3,706,344 | 12/1972 | Vann | 166/297 |
| 3,800,705 | 4/1974 | Tamplen | 102/20 |
| 4,041,865 | 8/1977 | Evans et al. | 102/202.2 X |
| 4,484,639 | 11/1984 | Ayers | 175/4.56 |
| 4,512,406 | 4/1985 | Vann et al. | 166/297 |

OTHER PUBLICATIONS

Johnston Perforating Services, advertising brochure, Johnston Testers, Inc., 1953.

*Primary Examiner*—Stuart S. Levy
*Assistant Examiner*—David Werner
*Attorney, Agent, or Firm*—Patrick H. McCollum

[57] ABSTRACT

Method and apparatus for firing perforating apparatus in a borehole. A mechanically operated firing assembly is run into the borehole on the end of a cable and latched onto a perforating apparatus. Tension is pulled on the cable. At a predetermined tension force a firing rod is automatically released and as a result of force exerted by a compression spring driven into impactment with a percussion firing head to thereby detonate the perforating apparatus. Additionally, the firing assembly can be reset by application of downward force thereto.

12 Claims, 4 Drawing Figures

METHOD AND APPARATUS FOR FIRING BOREHOLE PERFORATING APPARATUS

BACKGROUND OF THE INVENTION

This invention relates generally to subsurface well apparatus, more specifically, to apparatus for perforating subsurface earth formations, and particularly to apparatus for firing tubing conveyed perforating apparatus.

It has become common practice in the completion of oil and gas wells to perforate the well casings and the surrounding formations to bring a well into production. One method of providing this capability has a perforating apparatus attached to the end of a tubing string which is lowered and set in place when the perforating apparatus is opposite the formation to be produced. The perforating apparatus may then be detonated and the well placed into production through the tubing strings.

The systems for firing the perforating devices have typically been either an electrical firing system or a non-electric percussion firing system activated by dropping a member through the tubing. Neither method has been entirely satisfactory in the past. Electrical firing systems require care in connecting and running and can be activated from stray electrical currents. In addition, electrical connections can be short-circuited by moisture. Percussion firing systems commonly require a bar member, referred to as a "go devil", be dropped through the tubing string thereby impacting a percussion firing assembly. These percussion firing assemblies typically have some primary explosives in the perforating apparatus while it is affixed to the tubing and lowered into position within the well. As a result of the deficiencies of these systems, accidental and premature firings are a possibility. Further, in the event of a malfunction of these systems there is a need of a suitable back-up method of firing the perforating apparatus.

These and other disadvantages are overcome with the present invention by providing method and apparatus for firing subsurface perforating apparatus using a mechanical operated firing system capable of operation from a "slick line" or other non-electrical cable.

SUMMARY OF THE INVENTION

In a preferred embodiment of the invention, a mechanically operated firing assembly for use in conjunction with a tubing conveyed perforating system is provided. The firing assembly is connected to a cable and lowered into latching engagement with the tubing conveyed perforating apparatus. Tension is pulled on the cable causing rod members within the firing apparatus to move longitudinally to thereby compress one or more spring members located within the firing assembly. Once a predetermined tension force is exerted a firing rod is released whereby the force exerted by a spring forces the firing rod into a percussion firing assembly to thereby detonate the percussion firing assembly and the attached perforating apparatus.

BRIEF DESCRIPTION OF THE DRAWINGS

The FIGS. 1A–1D are a longitudinal view, partly in cross-section of the mechanical operated firing apparatus of the present invention.

DETAILED DESCRIPTION OF THE PREFERRED EMBODIMENT

Figure 1A:
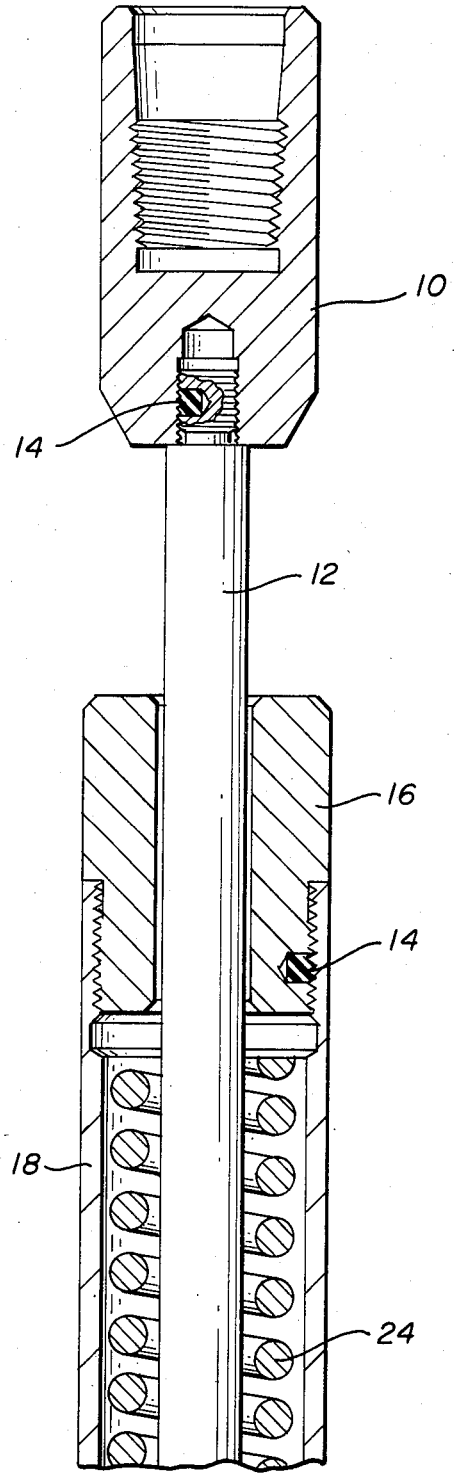
Figure 1B:
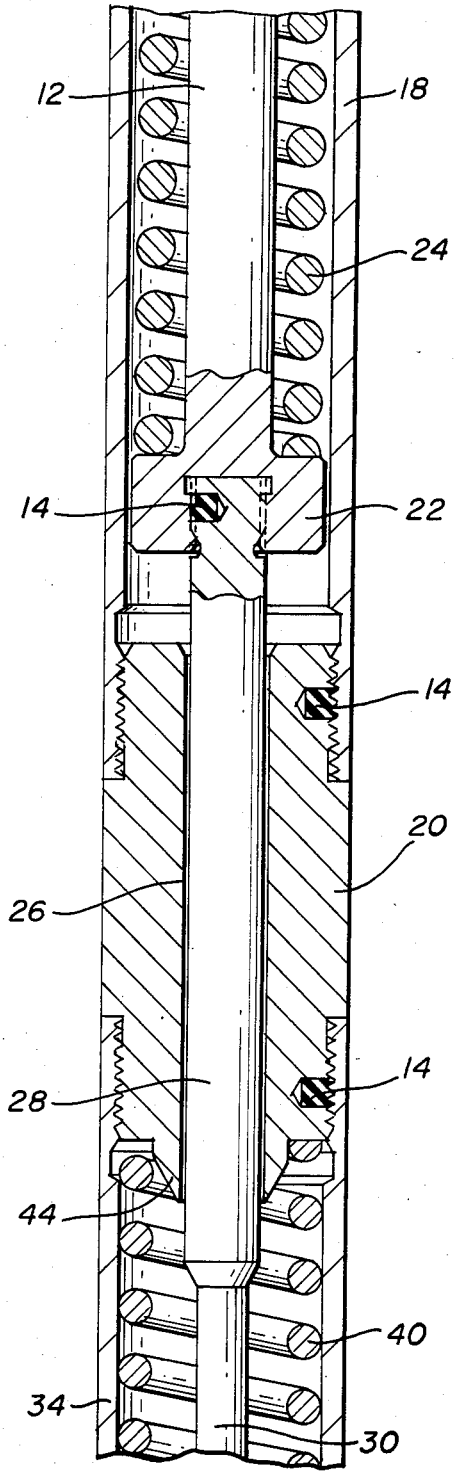
Figure 1C:
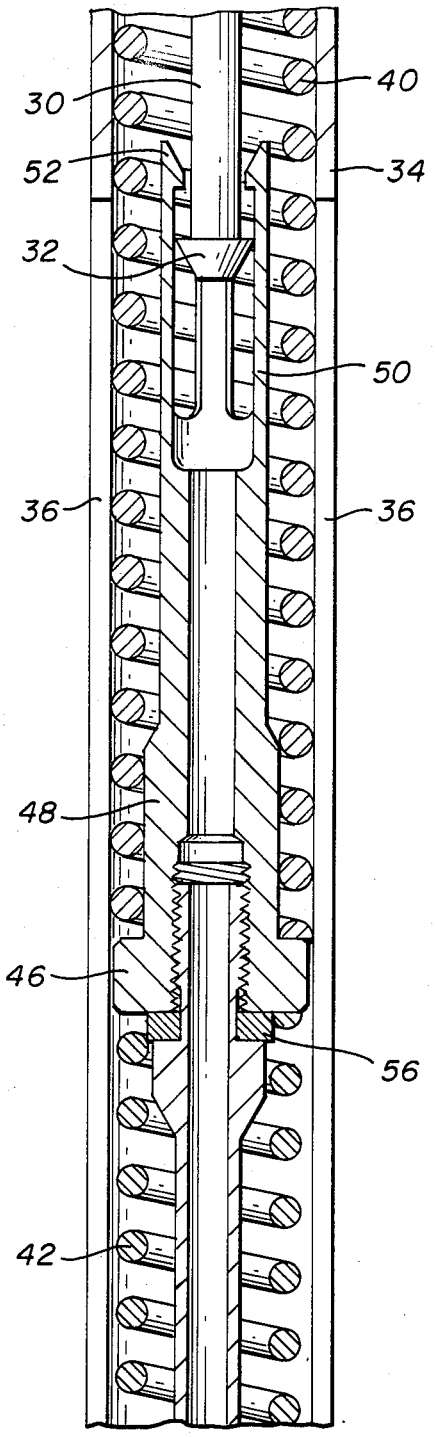
Figure 1D:
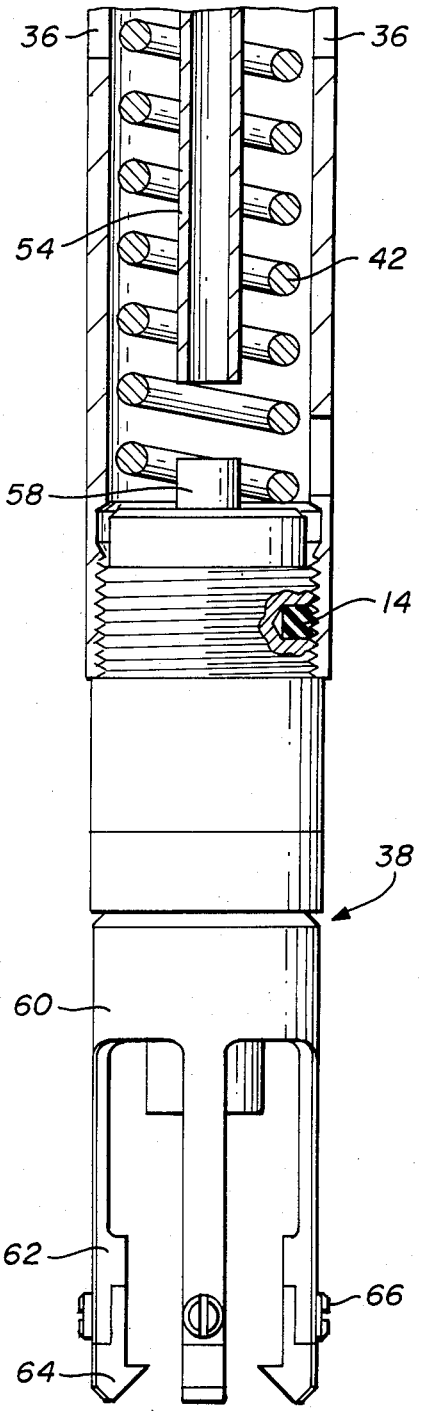

Referring now to the drawing in detail therein is illustrated a section view of the firing apparatus in accordance with the present invention. The apparatus includes a connector sub 10 which is a generally cylindrical member having an internally threaded cavity therein for attachment to the cable used to place the firing apparatus within the well. Since the firing apparatus is mechanically operated the cable need not contain any electrical conductors, thus a slick line or any other similar line can be used.

Connector sub 10 is threadably attached to a first end of rod member 12. Locking plug 14, an insert member constructed of a suitable material such as nylon, prevents rod member 12 from inadvertently becoming disconnected from connector sub 10. Rod member 12 extends through, and is longitudinally slidable within, a central bore within sub member 16. Sub member 16 is threadably coupled to one end of tubular housing section 18, the second end of which is threadably coupled to coupling sub member 20. Locking plugs 14 are utilized at both threaded couplings.

The second end portion of rod member 12 forms an enlarged diameter section 22. Disposed within housing section 18 is helical compression spring 24. Once terminus of spring 24 is in contact with the face of sub member 16 with the other terminus of spring 24 contacting the inner face of enlarged end portion 22 of rod member 12. In the preferred embodiment spring 24 has a compression factor of approximately one hundred and fifty pounds per inch.

Threadably engaged into the inner cavity at the end portion 22 of rod member 12 is a first end of rod member 26. Locking plug 14 prevents the inadvertent decoupling of rod member 26 from rod member 12. Rod member 26 has a first outer diameter portion 28 extending through and longitudinally slidable within, a cental bore in connector sub 20. Further, rod member 26 tapers to a reduced outer diameter section 30 terminating with a truncated conical second end portion 32.

Connector sub 20 is further threadably coupled to one end of tubular housing section 34. Housing section 34 includes a plurality of elongated slots, for example as shown at 36, for placing the internal cavity of housing section 34 into fluid communication with the wellbore. Locking plug 14 prevents the connection between connector sub 20 and housing section 34 from becoming inadvertently disconneted. Coupled to the second end of housing section 34 by means of a threaded connection is firing head assembly 38, which will be more fully described later herein. Locking plug 14 prevents the inadvertent decoupling of housing 34 from firing head assembly 38.

Disposed in the internal cavity of housing section 34 are spring members 40 and 42. Spring member 40 is a helical compression spring having a compression factor of approximately one hundred pounds per inch while spring member 42 is a helical compression spring having a compression factor of approximately eight pounds per inch. A first terminus of spring member 40 is in contact with the face of connector sub 20, the face having a generally flat outer portion with a tapered or conical profile 44 extending form the face into the internal cavity of housing section 34. The second terminus of spring member 40 contacts one face of an enlarged diameter portion 46 of rod member 48. The enlarged outer diameter portion is sized to be slidable within the interior of housing section 34.

Rod member 48 includes a longitudinal bore therethrough with an internally threaded section at enlarged diameter portion 46. At the second end rod member 48 includes a grapple including a plurality of fingers 50 terminating with inwardly directed dogs 52 having beveled ends. Connected to rod member 48 is rod member 54 which is of a generally tubular configuration having a threaded extension for engagement to rod member 48. Locking washer 56 prevents rod member 54 from inadvertent decoupling from rod member 48. Disposed about rod member 54 is spring member 42 having one end thereof positioned against the face of the enlarged diameter portion 46 of rod member 48 and the other end thereof positioned against face of firing head assembly 38.

In the preferred embodiment, firing head assembly 38 is a percussion firing assembly which includes a firing pin 58 extending from firing head assembly 38 into the internal portion of housing member 34. A plurality of percussion ignition pins are attached to the other end of firing pin 58. Explosive primer cartridges are retained below, and in line with, the percussion ignition pins. Located proximate the explosive primer cartridges is an explosive booster charge. A shaped charge is retained within the firing head assembly in juxtaposition with the booster and having its axis of perforation aligned substantially along the longitudinal axis of the firing head assembly. Grapple sub 60 includes a generally cylindrical portion having a plurality of elongated fingers 62 extending therefrom which terminate in inwardly directed dogs 64. Dogs 64 are attached to fingers 62 by means of screws 66. A more complete description of firing head assembly 38 can be found in U.S. patent application Ser. No. 06/516,812, which is incorporated herein by reference.

In the operation of the apparatus, the firing apparatus is connected to a cable, preferably a non-electrical slick line, at connector sub 10. The firing apparatus is lowered through a borehole until grapple sub 60 engages, and latches onto, a firing head within a tubing conveyed perforating apparatus having been set previously within the well in a manner common in the art. In the preferred embodiment grapple sub 60 will latch onto the perforating apparatus firing head at approximately fifteen pounds of downward force. To determine if the firing apparatus is latched onto the firing head of the perforating apparatus the operator can pull the cable slightly resulting in spring compression being indicated at the surface location.

After the firing assemble is latched onto the perforating apparatus, tension is pulled on the cable. This causes rod members 12 and 26 to move longitudinally within housing section 18 compressing spring member 24. With continued tension from the cable, end section 32 of rod member 26 engages dogs 52 pulling rod member 48 and thereby compressing spring member 40. As rod member 48 moves into proximity to connector sub 20, dogs 52 engage the tapered section on the face of connector sub 20 until dogs 52 are separated a sufficient amount to release from end portion 32 of rod member 26.

With the release of dogs 52 spring member 40 forces rod members 48 and 54 downward onto firing pin 58 resulting in ignition of firing head assembly 38 as fully explained in U.S. patent application Ser. No. 06/516,812. The force of spring member 42 then pushes rod member 54 back away from firing pin 58 into the position illustrated in the drawing. Additionally, the force exerted by spring member 42 prevents the accidental firing of firing head assembly 38 which could be caused by shock due to dropping the firing apparatus.

If required the firing apparatus can be reset in the well. To reset the firing apparatus downward force is exerted on rod member 12 and thus on rod member 26 attached thereto until end portion 32 is reset into the fingers 50 of rod member 48. The face of the enlarged diameter end of rod member 12 contacting the face of connector sub 20 prevents the resetting operation from accidentally firing the firing head assembly.

In the preferred embodiment approximately six hundred pounds of pulling force is required to fire the firing assembly. However, should it be desired to have firing at a reduced force spring member 24 is removed thereby allowing the apparatus to be fired at approximately two hundred fifty pounds of pull force. Once the firing operation is complete upward tension is applied until screws 66 shear allowing dogs 64 to disconnect from fingers 62. The firing assembly can then be removed form the well.

Many modifications and variations besides those specifically mentioned herein may be made in the techniques and structures described herein and depicted in the accompanying drawing without departing substantially from the concept of the present invention. Accordingly, it should be clearly understood that the form of the invention described and illustrated herein is exemplary only, and is not intended as a limitation on the scope of the present invention.

The embodiments of the invention in which an exclusive property or privilege is claimed are defined as follows:

1. Apparatus adapted to be lowered into a borehole by means of a cable for firing a perforating gun disposed within said borehole, comprising:

an elongated housing member;

a first rod member having a first and second end disposed and longitudinally slidable within said housing member, the first end of said first rod member being coupled to said cable;

a second rod member having a first and second end disposed and longitudinally slidable within said housing member, the first end of said second rod member being detachable coupled to the second end of said first rod member;

means for decoupling said second rod member from said first rod member in response to the longitudinal movement of said first rod member; and first biasing means disposed about at least a portion of said second rod member for exerting a force on said second rod member to cause downward longitudinal movement thereof when decoupled from said first rod member.

2. The apparatus of claim 1 wherein said means for decoupling said second rod member from said first rod member comprises a face surface within said housing member having a conical profile extending therefrom.

3. The apparatus of claim 2 wherein said second end of said first rod member comprises a truncated conical end portion.

4. The apparatus of claim 3 wherein said first end of said second rod member comprises a grapple end portion.

5. The apparatus of claim 4 wherein said grapple end portion comprises a plurality of fingers terminating with inwardly directed dogs.

6. The apparatus of claim 1 wherein said first rod member comprises:

a third member having a first and second end, the first end coupled to said cable; and a fourth rod member having a first end coupled to the second end of said third rod member.

7. The apparatus of claim 6 wherein said second rod member comprises:

a fifth rod member having a first and second end, the first end detachably coupled to said first rod member; and a sixth rod member having a first end coupled to the second end of said fifth rod member.

8. Apparatus adapted to be lowered into a borehole by means of a cable for firing a perforating gun disposed within said borehole, comprising:

an elongated housing member;

a first rod member having a first and second end disposed and longitudinally slidable within said housing member, the first end of said first rod member being coupled to said cable, said first rod member comprising a third member having a first and second end, the first end coupled to said cable, and a fourth rod member having a first end coupled to the second end of said third rod member;

a second rod member having a first and second end disposed and longitudinally slidable within said housing member, the first end of said second rod member being detachable coupled to the second end of said first rod member, said second rod member comprising a fifth rod member having a first and second end, the first end detachably coupled to said first rod member and a sixth rod member having a first end coupled to the second end of said fifth rod member;

means for decoupling said second rod member from said first rod member in response to the longitudinal movement of said first rod member;

first biasing means disposed about at least a portion of said second rod member for exerting a force on said second rod member to cause longitudinal movement thereof when decoupled from said first rod member; and second biasing means disposed about said third rod member for exerting a force on said third rod member.

9. The apparatus of claim 8 further comprising a third biasing means for exerting a force on said second rod member, said force in opposition to the force exerted by said first biasing means.

10. The apparatus of claim 1 further comprising an impact sensitive firing head coupled to said housing member including an impact firing pin substantially in line with said second rod members.

11. The apparatus of claim 10 wherein said firing head further comprises a grapple end portion for engaging said perforating gun.

12. The apparatus of claim 11 wherein said grapple end portion comprises a plurality of fingers terminating with inwardly directed dogs.

* * * * *